United States Patent [19]

Desarzens

[11] 4,156,870

[45] May 29, 1979

[54] SPORTS TIMING SYSTEM

[75] Inventor: Pierre Desarzens, Bienne, Switzerland

[73] Assignee: Societe Suisse pour l'Industrie Horlogere Management Services S.A., Switzerland

[21] Appl. No.: 794,680

[22] Filed: May 6, 1977

[30] Foreign Application Priority Data

May 12, 1976 [FR] France ..... 76 14362

[51] Int. Cl.[2] ..... A63K 3/00; G08B 23/00

[52] U.S. Cl. ..... 340/323 R; 235/92 GA; 235/92 T; 272/4

[58] Field of Search ..... 340/323, 309.4, 147 R, 340/168 B; 272/4; 364/411; 235/92 GA, 92 PE, 92 T

[56] References Cited

U.S. PATENT DOCUMENTS

| | | | |
|---|---|---|---|
| 3,434,712 | 3/1969 | Matsumura et al. | 272/4 |
| 3,508,034 | 4/1970 | Toyama et al. | 235/92 GA |
| 3,764,981 | 10/1973 | Takasugi | 340/147 LP |
| 3,795,907 | 3/1974 | Edwards | 340/323 |

*Primary Examiner*—Donald J. Yusko

*Attorney, Agent, or Firm*—Griffin, Branigan and Butler

[57] ABSTRACT

The invention concerns sports timing systems and in particular connections between a central processor which determines the performances of the competitors and the peripheral devices which provide such processor with the necessary information such as starting and arrival times, intermediate times and as well as any other information necessary for the identification of the device concerned or of the competitor.

12 Claims, 3 Drawing Figures

SPORTS TIMING SYSTEM

BACKGROUND OF THE INVENTION

In known sports timing systems the peripheral devices such as the starting pistol, starting gate or platform, photocell and arrival sensing means which provide electrical impulsions in response to the determining events, are coupled to a central processor which controls the operations as well as the processing of the information in each case through at least two conductive wires.

In the special case of swimming competitions to which the following detailed description will be limited the greatest difficulties seem to arise and the invention is revealed to its greatest advantage. Nevertheless, the invention may, without any particular difficulty, be adapted to other domains. In a swimming pool each swimming lane may be equipped with three peripheral devices, namely an arrival touch plate, a manual switch for duplicating the measurements by an official and a starting platform which moreover enables the determination of errors during relay races. For a swimming pool having ten lanes one may easily determine that a minimum of 31 conductive wires is necessary if it is acceptable to use one wire common to all devices and in most cases where such is not acceptable there will be a total of sixty wires.

The difficulties arising from such an arrangement are known . . . . The cabling is heavy and quite expensive, above all in the case of systems which are intended to be moved around from pool to pool. Moreover, numerous multipin connectors will be required and these are likewise expensive. Finally, all connections and connectors must be and remain watertight, this being furthermore an important element in the costs. The invention described in Swiss Pat. No. 572,250 which enables working with touch pads having contacts immersed in the water does not eliminate the necessity that all lines must be watertight after coming out of the electronics involved in such touch pads. In addition to their high price, known systems may thus have considerable and serious problems of reliability in view of the multiplicity of connectors and connections.

SUMMARY OF THE INVENTION

The present invention proposes to overcome these problems through the utilisation of a single common two-wire cable shared among the peripheral devices for communicating with the central processor.

In a special arrangement for competitions in which several competitors are simultaneously competing, each along a track reserved to such competitor, in particular a lane in a swimming pool, the peripheral devices equipping this track or lane are coupled to the two-wire cable by a common electronic module.

DETAILED DESCRIPTION OF THE INVENTION

Figure 1:
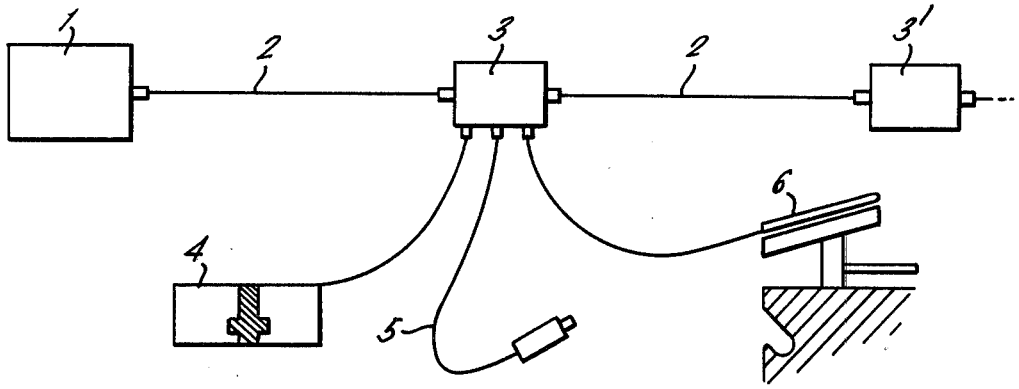
FIG. 1 is a schematic representation of a timing installation in accordance with the invention.

In FIG. 1 which represents an installation according to the invention, intended for swimming competitions, there is provided a plurality of parallel water lanes each one reserved to a competitor. The central processor 1 for controlling the functioning of the system and the processing of information for the determination of the performance of the competitors, is coupled by means of a single two-wire cable 2 to electronic modules 3, 3', etc. mounted in series along the two-wire cable 2 and corresponding each to a water lane. To each module 3 there are connected in parallel the peripheral devices associated with the water lane for example, an arrival touch pad 4, a manual switch 5, which may be operated by a member of the timing staff, and a starting platform 6. In the case of a manual timing installation one may have in place of the touch pad 4 and platform 6 two further manual switches identical to switch 5.

In view of the serial arrangement of modules 3, 3', etc. their connection to the two-wire cable 2 may be made by means of insertable plug connectors which greatly facilitate set up and replacement thereof in the case of defects. Each module 3 includes the necessary electronics for transmitting by means of cable 2 information in the form of pulses coming from the peripheral devices 4, 5, 6 to the central processor 1 and for transmitting to the peripheral devices instructions coming from the processor. In the same manner the energizing of modules 3 and of peripheral devices 4, 5 and 6 is effected from central processor 1 by means of the two-wire cable 2.

Each module 3 may moreover include the electronic circuit as described in Swiss Pat. No. 572,250 already mentioned, this permitting working with submerged contacts. However, from the connection of the peripheral devices 4, 5, 6 to modules 3 and thence to the central processor 1 the connections should be watertight. Also the electronic portions of modules 3 will be preferably sealed into molded rubber housings as will the two pin plugs for connections between modules 3, 3', etc. and cable 2.

Figure 2:
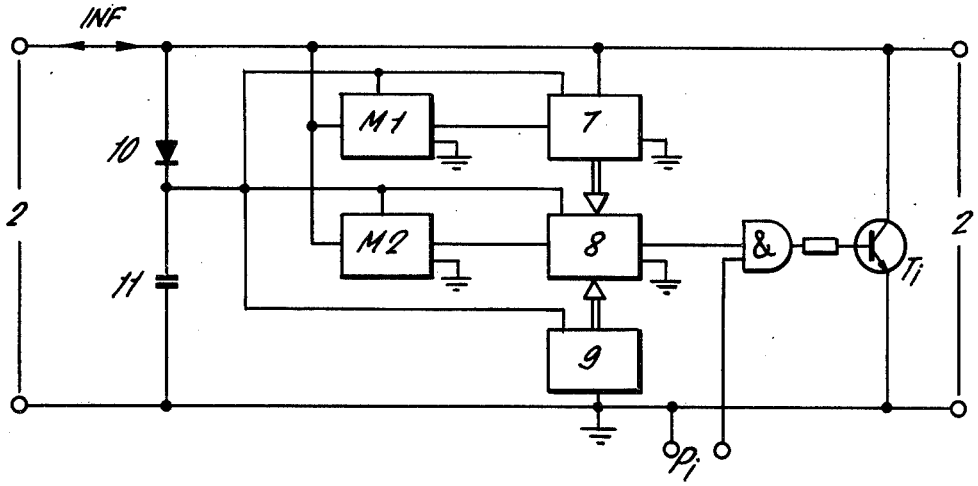
FIG. 2 is the schematic drawing of an electronic module for coupling a peripheral device to the two-wire cable.
Figure 3:
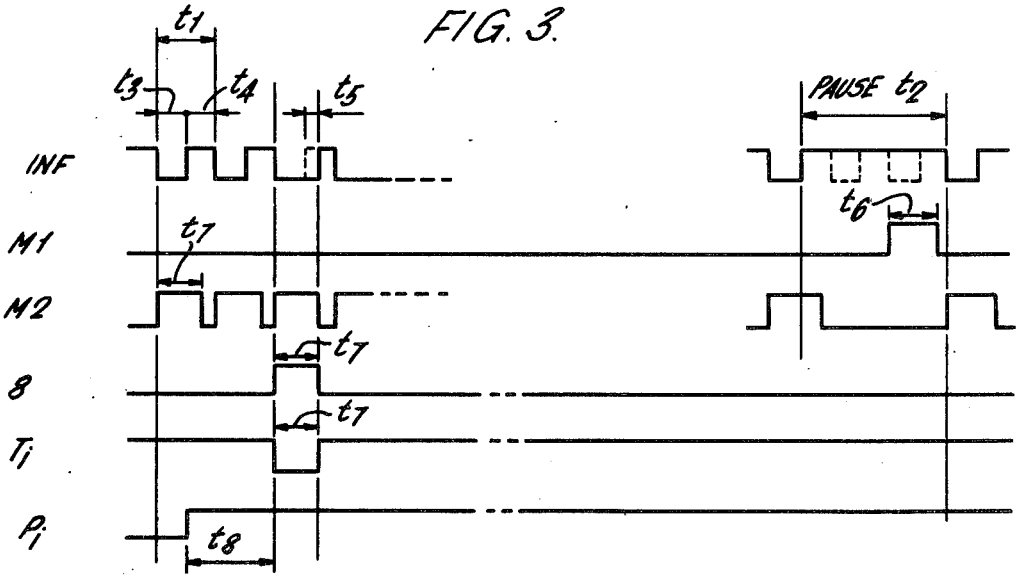
FIG. 3 shows timing of electrical signals at various points in the schematic diagram of FIG. 2.

FIG. 2 shows a schematic diagram of a possible arrangement of the electronics in a module 3 in order to form an interface for a peripheral device $P_i$. Reference should be made to this schematic and to FIG. 3 for a better understanding of the functioning of the arrangement. The two-wire cable 2 is represented by its two conductors. It is traversed in both senses by the information "INF" in the form of logic pulses. The central processor 1 continuously feeds cable 2 with trains of thirty clock signals of a period $t_1$ separated by intervals $t_2$ each of which corresponds in duration to two periods $t_1$. For each clock signal the logic level "0" is maintained during $t_3$ and the "1" level during $t_4$. These signals are received by a counter 7 and by a monostable device $M_1$ which, as soon as no further signals are received, delivers a signal of duration $t_6$ for resetting counter 7 to zero. The contents of counter 7 are compared with the code number "i" of the peripheral device $P_i$ by a comparator 8. The code "i" is prewired into the module 3 as indicated by block 9. When counter 7 reaches a count equal to code "i", which it maintains for the duration of a clock signal, comparator 8 as controlled by a second monostable device $M_2$ which also receives clock signals, delivers an output signal during a period $t_7$. The monostable device $M_2$ thus functions to furnish an enabling signal of duration $t_7$ which permits comparator 8 during this period to transfer its information. The monostable device $M_2$ is triggered on each falling edge of a clock signal and remains set for the period $t_7$ where $t_1 > t_7 > t_3$. The comparator signal is transmitted to a NAND-gate the second input of which is coupled to the output of the peripheral device $P_i$. The output of the NAND-gate is coupled to the base of a transistor $T_i$ of which the emitter and the collector are coupled respectively to each of the wires of cable 2.

During the period $t_7$ the state of the peripheral device $P_i$ will be probed. If, for the duration of signal, $P_i$ does not provide any information, that is to say remains at the logic "0" level, the NAND-gate will not transmit a signal, the transistor $T_i$ remains blocked and the clock signals "INF" recommence immediately following $t_3$. If, on the contrary, $P_i$ provides a logic "1" $T_i$ becomes conductive and imposes a "0" level to "INF" for the period $t_7$. The clock signals or "INF" may not return to the "1" level until after the period $t_5 = t_7 - t_3$ which follows the rising edge of the pulse. Precisely, during this period $t_5$ the central processor may interrogate the line and determine if the information "INF" is at the "0" level indicative that the peripheral device $P_i$ has emitted a signal. At the end of each cycle ending with the interval $t_2$ all elements are returned to their initial condition, counter 7 being reset to zero by the signal of duration $t_6$ from monostable device $M_1$.

The cycle repetition rate must be sufficiently high to ensure that the period $t_8$, between the instant when the peripheral device $P_i$ gives forth its information and that when such information is recognized and recorded by the central processor 1, is negligible relative to the desired precision of the timing.

Each module 3 is energized from the central processor 1 by the two-wire cable 2. During the periods $t_4$ at level "1" the central processor 1 provides a current which charges a capacitor 11 across a diode 10 and thus provides the system with the necessary energy during the periods $t_3$ at the "0" level of the clock signals.

Where several peripheral devices $P_i$ are required as shown in FIG. 1 the portion of the circuit comprising the two monostable devices $M_1$ and $M_2$ and the counter 7 may be common to these particular devices, but the portion comprising comparator 8, the source for the code "i", the NAND-gate and the transistor $T_i$ are individual to the peripheral device under consideration.

In an alternative arrangement a module 3 may be associated with each peripheral device $P_i$ and may be made an integral part of such peripheral device which is thus coupled directly to the two-wire cable 2.

What is claimed is:

1. A sports timing system comprising:

central processor means;

a plurality of peripheral devices;

a plurality of event sensing means for sensing events relating to competitors' starting times, arrival times or intermediate times;

a single two-wire cable connected between said central processor means and said peripheral devices;

first means in said central processor means for repeatedly and alternately impressing first and second voltage differentials across the two wires of said cable to thereby transmit clock pulses to said peripheral devices;

said peripheral devices including second means responsive to said event sensing means and said clock pulses for modifying the first voltage impressed across said two wires by said first means when an event is sensed; and, said central processor means including means for sensing that a voltage differential impressed across said two conductors by said first means has been modified by said second means.

2. A sports timing system as set forth in claim 1 for competitions in which several competitors are simultaneously engaged, each in his own track, the peripheral devices associated with each track being coupled to the two-wire cable through a common electronic interface module.

3. A sports timing system as set forth in claim 2 for swimming competitions, each track comprising a water lane in a swimming pool.

4. A sports timing system as set forth in claim 2 wherein the interface module includes a comparator and a code generator for each peripheral device whereby the processor means is enabled to communicate separately with each peripheral device.

5. A sports timing system as claimed in claim 1 for use in timing competitions of the type wherein each competitor has his own track, there being plural event sensing means associated with each track, said system having one of said peripheral devices for each of said sensing means.

6. A sports timing system as claimed in claim 5 wherein all of the peripheral devices associated with a single track are enclosed within a single module and said second means in a single module comprises:

a single counter for counting said control pulses;

a code generator, a comparison means, and a gating means corresponding to said event sensing means;

said comparison means each comparing the count in said counter with the code generated by one of said code generators, and enabling one of the gating means;

said event sensing means being connected to individual ones of said gating means.

7. A sports timing system comprising:

a central processor;

a plurality of peripheral devices;

a single two-conductor cable connected to said central processor;

means in said central processor for generating a sequence of clock pulses;

means in said central processor for applying said clock pulses to said cable as a voltage differential between the two conductors of the cable which varies between a first and a second voltage differential during first and second intervals, respectively, of each clock pulse cycle;

a plurality of event sensing means for sensing events relating to competitors' starting, arrival or intermediate times, and producing a control signal for each event sensed;

a plurality of peripheral devices having:

code generator means;

counter means for counting said clock pulses;

comparison means for comparing the count in said counter means to the code generated by said code generator means and generating a comparison signal when said count is equal to said code; and, gating means responsive to said comparison signal and a said control signal for modifying the voltage differential between said two conductors during said second interval of a single clock pulse cycle to thereby place on said conductors a signal indicating that an event has been sensed.

8. A sports timing system as claimed in claim 7 for use in timing competitions of the type wherein each competitor has his own track, there being plural event sensing means associated with each track and one of said peripheral devices associated with each sensing means, the peripheral devices for a single track being enclosed within a single housing.

9. A sports timing system as claimed in claim 8 wherein each track is a lane in a swimming pool and said housings are water-tight.

10. A sports timing system as claimed in claim 7 wherein each said gating means comprises a logical gate and a transistor, said transistor having a collector and emitter connected to respective ones of said two wires and a base connected to said logical gate.

11. A sports timing system as claimed in claim 7 wherein the code generator means in each peripheral device generates an address code different from the address code generated by any other peripheral device.

12. A sports timing system as claimed in claim 7 wherein said counter means comprises a single counter shared by a plurality of said peripheral devices.

* * * * *